US005533209A

United States Patent [19]

Davis

[11] Patent Number: 5,533,209

[45] Date of Patent: Jul. 9, 1996

[54] CONVERTIBLE WEARING APPAREL

[75] Inventor: Michael Davis, Toronto, Canada

[73] Assignee: Snugabye Inc., Canada

[21] Appl. No.: 265,358

[22] Filed: Jun. 24, 1994

[51] Int. Cl.[6] ..... A41B 7/00; A41B 7/10; A41D 10/00; A41D 11/00

[52] U.S. Cl. ..... 2/60; 2/80; 2/83; 2/158; 2/269; 2/69; 66/171

[58] Field of Search ..... 2/59, 60, 75, 80, 2/83, 239, 79, 227, 240, 409, 158, 159, 160, 162, 269, 247, 69, 69.5; 66/178 R, 178 A, 182, 183, 184, 189, 185, 188, 186, 187, 171, 170, 174, 175, 177

[56] References Cited

U.S. PATENT DOCUMENTS

| | | | |
|---|---|---|---|
| 1,855,590 | 4/1932 | Stein | 2/269 |
| 2,166,328 | 7/1939 | Spatz | 2/269 |
| 2,214,120 | 9/1940 | Connor | 2/269 |
| 2,299,982 | 10/1942 | Harrison | 2/269 |
| 2,905,944 | 9/1959 | Stuart et al. | 2/83 |
| 3,329,972 | 7/1967 | Schwab et al. | 2/80 X |
| 3,381,311 | 5/1968 | Wormser | 2/80 X |
| 4,359,784 | 11/1982 | Harrington | 2/269 |
| 4,475,253 | 10/1984 | Laveckis | 2/269 |
| 4,944,041 | 7/1990 | Buenos et al. | 2/84 |
| 5,067,179 | 11/1991 | Wormser | 2/269 |
| 5,308,275 | 5/1994 | Kornbleuth | 2/115 |

*Primary Examiner*—Jeanette E. Chapman
*Attorney, Agent, or Firm*—Kenneth M. Garrett

[57] ABSTRACT

A garment suited for a young child comprises cuffs which are devoid of any hem at their distal end and which have hidden side seams. A pouch overlays the cuff at the distal end; the pouch is invertible over the cuff end to enclose an appendage such as a hand or foot of the wearer within the cuff. When the pouch is not inverted, the cuff may be turned back to expose the appendage.

21 Claims, 4 Drawing Sheets

CONVERTIBLE WEARING APPAREL

FIELD OF INVENTION

This invention relates to wearing apparel. It particularly relates to wearing apparel which is convertible between a first mode wherein a limb appendage such as a hand or foot will be exposed from the apparel, and a second mode in which the appendage is enclosed.

BACKGROUND OF INVENTION

Infant's sleepers which are in a sense convertible are known in the art. The garment includes sleeves on the outer surface of which at the distal end thereof is provided a pouch. The pouch is formed by a layer of material overlaying the front or the back of the sleeve, which layer is stitched into the side seams and bottom hem of the sleeve, and accordingly, the pouch has a blind-bottom.

The pouch is invertible over the end of the sleeve so as to close the sleeve end and thereby prevent the hand of an infant from projecting beyond the sleeve end. When the pouch is inverted in this manner, it tends to reduce the length of the sleeve, and to bunch up several thicknesses of material into the sleeve end. Since the sleeves of the garment must be made sufficiently long to accommodate the hands of the infant within the sleeves when these are closed by the pouches, it follows that the hands will not tend to project beyond the sleeve ends when these are uncovered, and the garment as a whole tends to be oversized and not to conduce to the comfort of the infant. While the sleeves could conceivably be rolled back on the garment so as to expose the infant's hands, this would also expose the hems and seams, and would present an unattractive appearance.

It is an object of this invention to provide improved wearing apparel which is of use for more controllably and more attractively converting between one mode in which a limb appendage is covered and another mode in which the limb appendage is uncovered.

SUMMARY OF THE INVENTION

In accordance with one aspect of this invention, an item of wearing apparel comprises a tubular cuff for fitting about the distal end of the limb and its appendage, which cuff includes a pouch at its distal end. The cuff is structured so as to be easily turned back, so as to uncover the appendage and cover the pouch. When the cuff is turned down, the pouch exposed, and is invertible over the distal end of the cuff so as to close the appendage within the cuff, whereby the cuff will function as a bootie or a mitten. The pouch has an internal passage at the bottom thereof which connects to the interior of the cuff, and is devoid of any hem. When the pouch is Inverted over the cuff end, the length of the cuff is essentially unaltered, and material is not bunched up into the cuff.

In accordance with another aspect of the invention, the cuffs are layed-up by folding two strips of material, which are sewn together at seams along their longitudinal sides and then inverted to totally enclose and hide the seams. The folds of the strips of material define the ends of the cuffs; accordingly, the cuffs are devoid of any hems or exposed seams, and present a smooth, stitch free surface for contact with the infant's skin and an attractive appearance when turned back.

Garments incorporating the cuffs about leg openings or arm openings can be made more form-fitting in comparison to the prior art convertible garments, and will controllably cover the hands and feet of an infant when this is desired, or expose them when desired.

The foregoing objects and aspects of the invention, together with other objects, aspects and advantages thereof will be more apparent from a consideration of the following description of the preferred embodiment thereof taken in conjunction with the drawings annexed hereto.

DESCRIPTION OF THE PREFERRED EMBODIMENT

Figure 12:
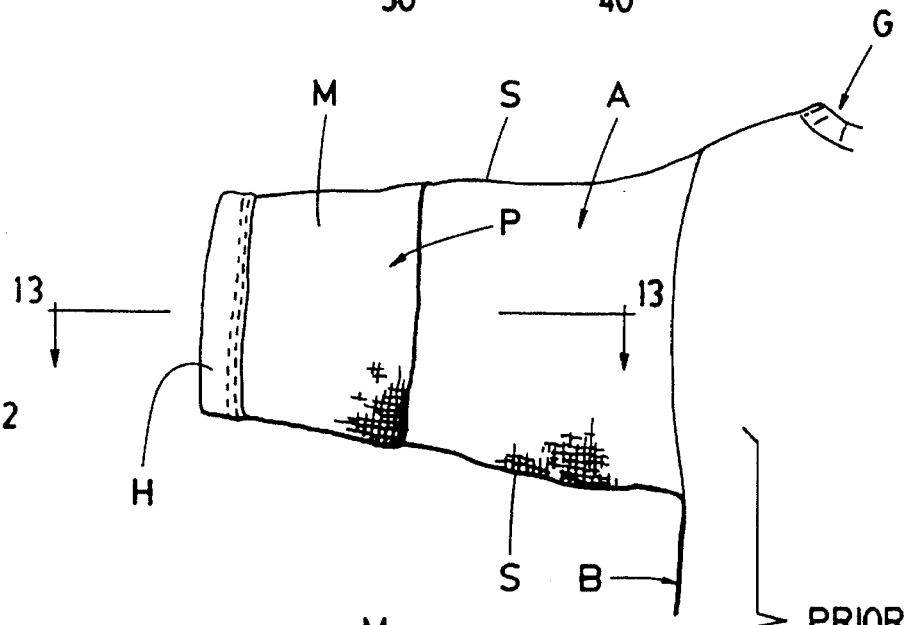
FIG. 12 shows a portion of a garment of the prior art with a sleeve pouch.
Figure 13:
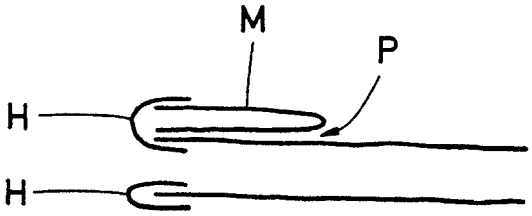
FIG. 13 is a cross-section on line 13—13 of FIG. 12.
Figure 14:
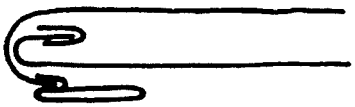
FIG. 14 PRIOR ART
FIG. 14 is similar to FIG. 13, but shows the pouch inverted over the sleeve end.

Considering the drawings in detail, and initially with reference to FIGS. 12–14, an infant's sleeping garment of the prior art includes a body portion B with arms A which taper towards their distal ends, which ends are open to permit an infant's hands to project therethrough. Arms A are made up from front and back portions of generally identical dimensions, which portions are joined together at each side along their length at seams S. A strip of material M folded end to end overlays the back portion of arm A adjacent the distal end, the free ends of the strip being joined to the free end of the back portion of the arm at a hem H which circumscribes the open end of the arm. The strips of material M are also joined to arms A at seams S, to form with the arms pouches P, the entrance of each pouch facing away from the distal end of the associated arm A. As seen in FIG. 14, the pouch P may be inverted over the end of arm A to close the end. However, this has the effect of shortening the length of the arms A, and of bunching up material within the ends of the arms.

Figure 1:
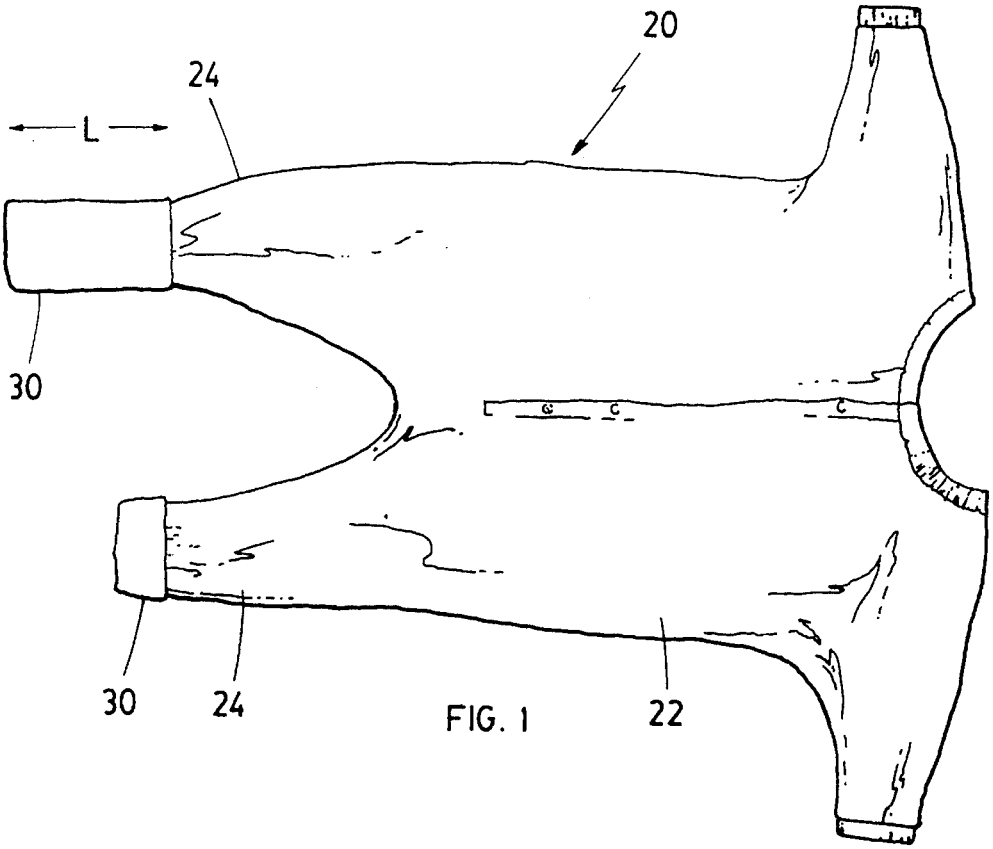
FIG. 1 shows in front elevation an infant's garment embodying the invention, with one leg cuff extended and the other leg cuff turned back.
Figure 8:
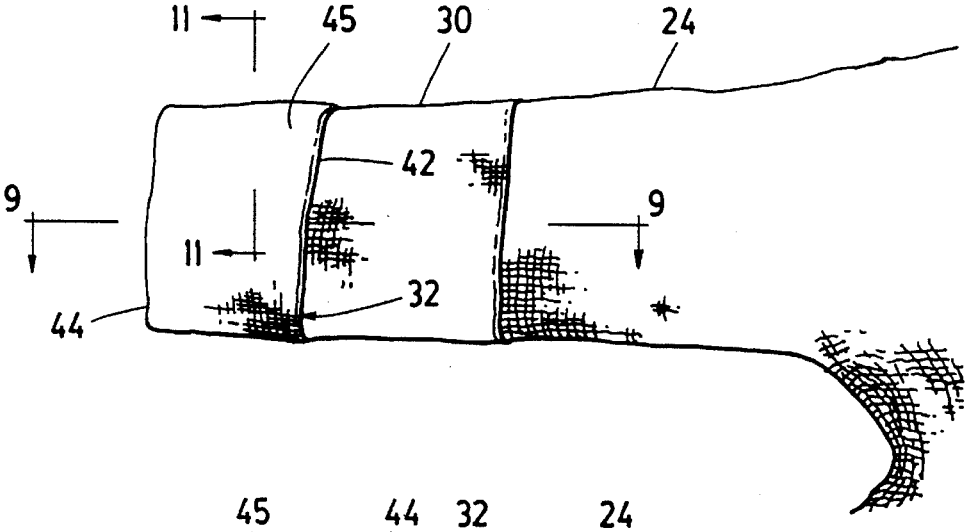
FIG. 8 shows in rear elevation a leg portion of the garment of FIG. 1
Figure 9:
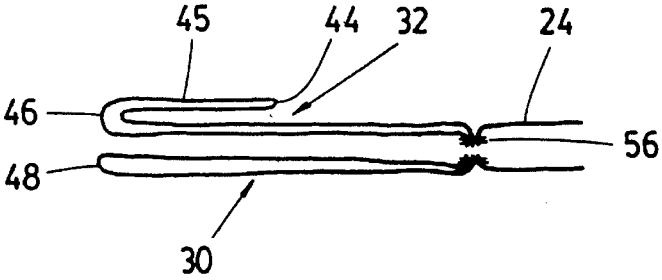
FIG. 9 is a section on line 9—9 of FIG. 8.
Figure 10:
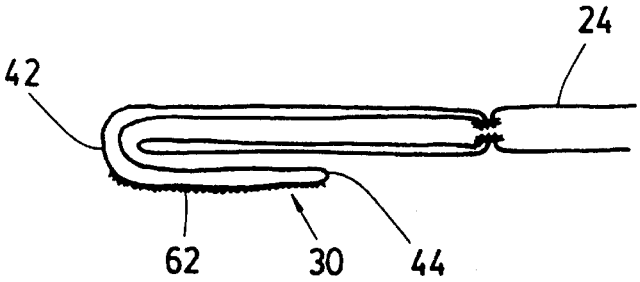
FIG. 10 is similar to FIG. 9, but shows the pouch of the leg cuff inverted to close the cuff.
Figure 11:
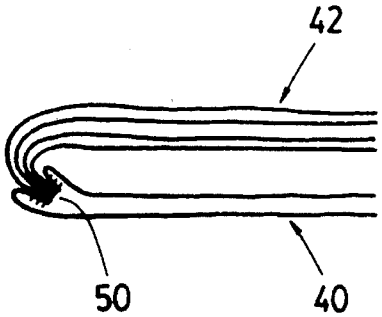
FIG. 11 is a cross-section on line 11—11 of FIG. 8.

With reference now to FIG. 1, an infant's garment constructed in accordance with the invention is identified generally therein by the numeral 20. Garment 20 includes a body portion 22 with leg portions 24 extending therefrom which taper towards their distal end. Each of the leg portions 24 is provided with a tubular cuff 30, the left hand cuff being shown in its up-turned position, and the right hand cuff fully extended. The cuffs 30 when extended have a length L which is approximately equal to twice the length of the foot of the average infant for whom the garment 20 is intended, and when the cuff is upturned to the position of the left hand cuff of the garment of FIG. 1, the foot of the infant will normally project beyond the open end of the cuff. When the cuff 30 is in its extended position, it will normally cover the foot without requiring that the leg of the infant be retracted into the leg portion 24 of the garment 20. With reference to FIGS. 8–10, each cuff 30 has associated therewith a pouch 32 which in its normal position, seen in FIG. 9 permits the cuff to be turned back, and which in its inverted position, seen in FIG. 10 closes the end of the cuff.

Cuff 30 is constructed from two strips of equal width material 40, 42, which are considered to have an outer surface and an inner surface, and where the description warrants a differentiation, the letters "O" or "I" may be appended to the numerals.

Figure 2:
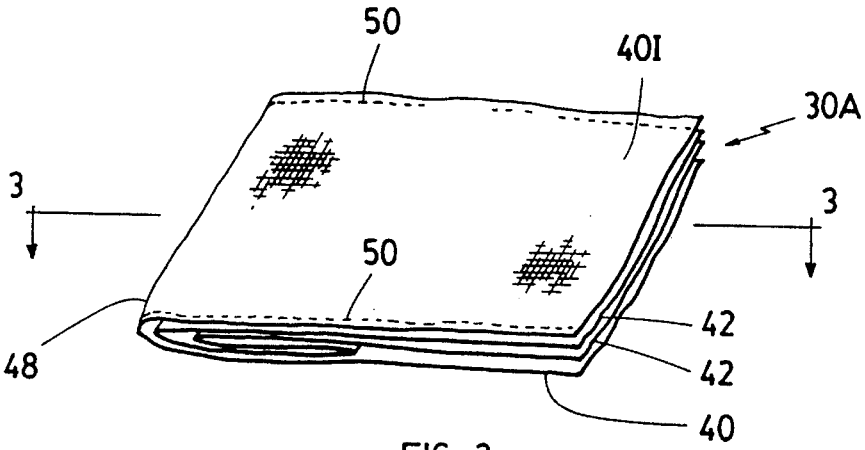
FIG. 2 shows in perspective schematic view a first step in the construction of a leg cuff of the garment of FIG. 1.
Figure 3:
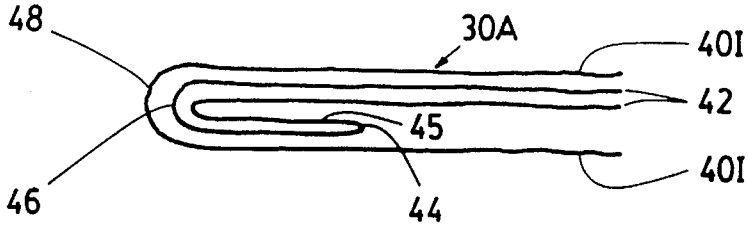
FIG. 3 is a cross section on line 3—3 of FIG. 2; in this and all other subsequently illustrated cross-sections, the layers are shown as being somewhat separated for clarity.
Figure 4:
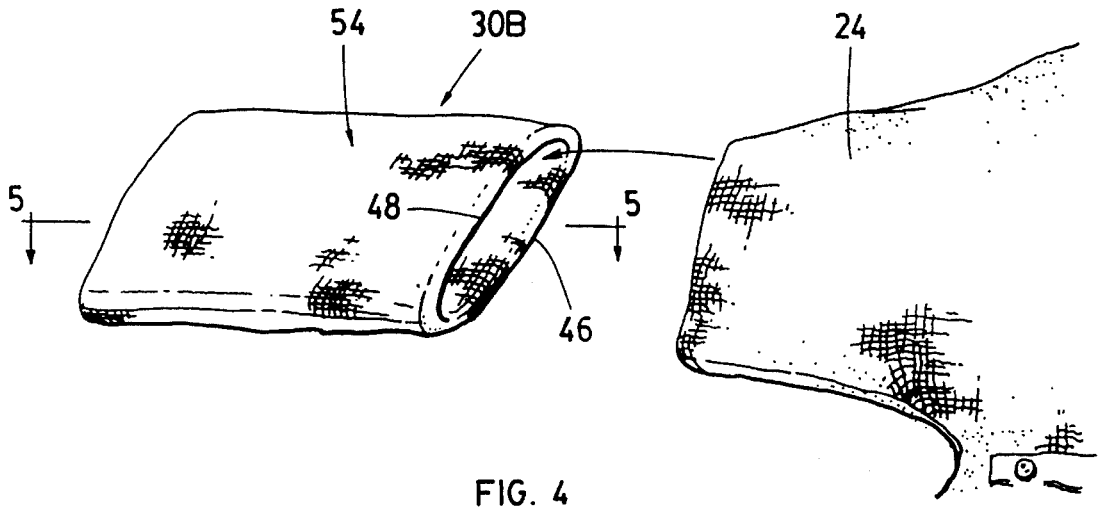
FIG. 4 shows a second step in the construction of the leg cuff and the manner of its combination with the body of the garment of FIG. 1
Figure 5:
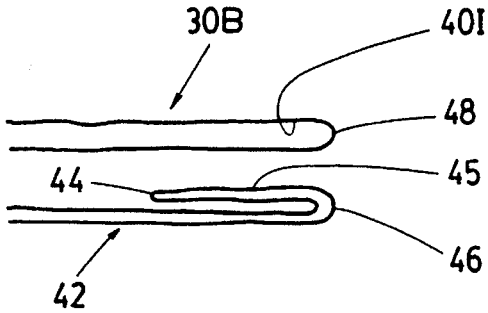
FIG. 5 is a cross section on line 5—5 of FIG. 4.
Figure 6:
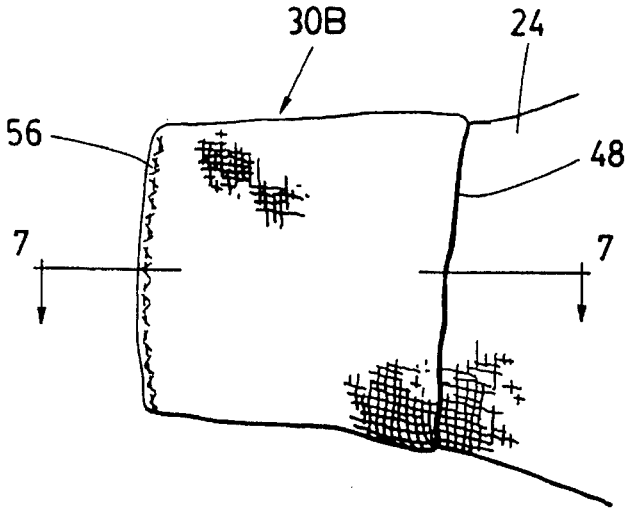
FIG. 6 shows the leg cuff joined onto the body of the garment of FIG. 1 in its inside-out condition, as sewn.
Figure 7:
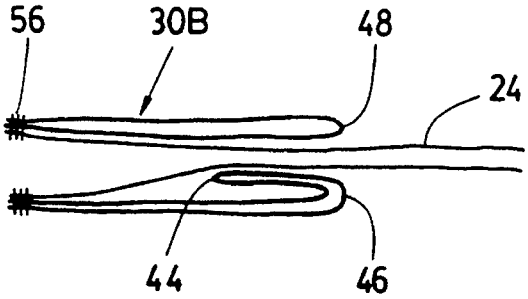
FIG. 7 is a cross-section on line 7—7 of FIG.

Strip 42 has a length of 3L, and is folded end to end with the outer surface facing outwardly at a first fold 44; the forward one third 45 of this folded strip is then over-folded, i.e. is folded back upon itself at a second fold 46 whereby the overall length of the doubly folded strip is equal to L. Strip 40 has a length equal to 2L, and is folded end to end with the inner surface facing outwardly at a fold 48 so as to envelope folded strip 42 therein, with the free ends of strips 40 and 42 superposed. The resulting multi-ply lay up is seen in FIGS. 2 and 3, and is seamed at each longitudinal side at stitched seam 50 to form a closed end cuff 30A. Closed end cuff 30A is inverted to form an open ended, inside out cuff 30B seen in FIGS. 4 and 5. A leg portion 24 of garment 20 is passed through the inside out cuff 30B and is joined to the free ends thereof at seam 56. Following this step, the inside-out cuff 30B is rolled downwardly over itself to form cuff 30 in its normal configuration in which it extends from leg portion 24.

With reference to FIG. ! 1, the formation of cuff 30 in the manner described above will be seen to enclose seams 50, so as to provide a smooth, stitch free finish along both the inside surfaces and the outside surfaces of the cuff 30. The formation in the above manner further serves to form associated pouch 32 which comprises the over-folded end portion 45 of the second strip 42. The arrangement provides a continuous passage between pouch 32 and the interior of cuff 30, devoid of any hem, and the inversion of the pouch to close the distal end of the cuff has a negligible effect upon the length of the cuff, and does not bunch-up material within the cuff.

While the material from which cuff 30 is formed is not critical, it is preferred that it be a fine jersey knit oriented so as to be more stretchable about the circumference of the cuff than along its length. A non-slip finish or layer 60 may be applied to the surface of pouch 32 which is outermost when the pouch is inverted to close the cuff end.

It will be apparent that many changes may be made to the illustrative embodiment while falling within the scope of the invention, and it is intended that all such changes be covered by the claims appended hereto.

I claim:

1. An item of wearing apparel comprising a tubular cuff having a first end and a second end opposed thereto;

said cuff having a length extending between said ends and a circumference therearound;

a pouch formed on the exterior of said cuff extending from said second end towards said first end over a first half of the circumference of said cuff;

said pouch and said first half of the circumference each comprising two layers of a first unitary piece of material folded at said second end;

said pouch being invertible over said second end to close said second end;

and wherein second half of said circumference comprises two layers of a second unitary piece of material folded at said second end.

2. An item of wearing apparel as defined in claim 1 wherein said pouch extends to about mid-distance between said first and second ends.

3. An item of wearing apparel as defined in claim 1, wherein said cuff is more stretchable in the circumferential direction than in the length.

4. An item of wearing apparel as defined in claim 1, wherein said cuff is formed from a jersey knit material oriented so as to be more stretchable in the circumferential direction than in the length.

5. An item of wearing apparel as defined in claim 1 wherein said first unitary piece of material and said second unitary piece of material is each a strip of fabric material.

6. An item of wearing apparel as defined in claim 5 wherein each of said strips of fabric material has a pair of free ends interconnected by sides and wherein said free ends are each disposed at said first end of said cuff, and wherein said first half of said circumference, said second half of said circumference and said pouch are joined together by hidden seams.

7. An infant's garment with at least one opening for a body appendage;

a cuff having a proximal end secured to said opening in surrounding relationship therewith and a distal end spaced apart therefrom by a length and having a circumference therearound;

said cuff comprising two portions joined together along the length of said cuff by a pair of seams respectively disposed at opposed sides of said circumference;

a pouch disposed on the exterior of said cuff extending from said distal end towards said proximal end in overlaying relationship with one of said portions of said cuff;

said one portion of said cuff comprising two layers of material folded over at said distal end to form said pouch;

the other of said two portions of said cuff comprising two layers of material folded over at said distal end;

said seams serving to secure said pouch to said cuff and being blind seams;

said pouch being invertible over said distal end to close said cuff.

8. An infant's garment as defined in claim 7, wherein said garment has two such openings for the limbs of an infant, wherein each said opening has a said cuff secured thereto.

9. An infant's garment as defined in claim 7 wherein said circumference is constant along the length of said cuffs.

10. The garment of claim 8 wherein said limb openings are leg openings.

11. An infant's garment as defined in claim 10 wherein said pouch has a length approximately equal to the length of an average infant's foot.

12. An infant's garment as defined in claim 10 wherein the surface of said pouch that is outwardly facing when said pouch is inverted is provided with a non-slip finish.

13. A method of forming a closeable cuff for a garment wherein said cuff has a length equal to approximately L;

said method comprising the steps of providing first and second strips of material each having a pair of free ends and a pair of longitudinal sides interconnecting said free ends;

folding said first strip of material so that said free ends thereof are superimposed to thereby create a folded end, then folding said folded end whereby said strip when so folded has a length equal to L; then folding said second strip of material about said folded first strip of material so that said free ends of each said strip are superimposed and the longitudinal edges of each said strip are superimposed, then joining said strips together with a seam extending along each longitudinal edge; then inverting said joined strips to form said cuff and enclose said seams.

14. A method as defined in claim 13 wherein said second strip of material has an inside surface and an outside surface differing in texture from said inside surface, and wherein when said second strip of material is folded about said first strip of material, said inside surface is outwardly facing.

15. A method as defined in claim 13 wherein said first and second strips are rectangular and of equal width.

16. A method as defined in claim 13 wherein said each said strip of material is a jersey knit oriented to be more stretchable along the width of the strip than along its length.

17. A method as defined in claim 13 wherein said first strip of material has a length of approximately 3 L.

18. An item of wearing apparel comprising a tubular cuff having a first end opposed to a second end and spaced therefrom by a length;

said cuff having a circumference therearound and being open at each said end;

a pouch formed on the exterior of said cuff extending to intermediate said ends over one half of the circumference of said cuff;

said pouch defining an opening facing said first end and a bottom at said second end with a passage therethrough which connects to the interior of said cuff;

said pouch being invertible over said second end of said cuff so as to close said second end; wherein said cuff is formed from two strips of material folded end to end, one of which is folded back upon itself to form said pouch, the said second end of said cuff being defined by folded portions of said strips.

19. An item of wearing apparel as defined in claim 18 wherein said folded strips are joined together along each longitudinal side thereof in an enclosed seam.

20. An item of wearing apparel as defined in claim 18 wherein said pouch extends to about mid-distance between said first and second ends.

21. An item of wearing apparel as defined in claim 18, wherein said cuff is more stretchable in the circumferential direction than in the length.

* * * * *